US005914010A

United States Patent [19]

Hood et al.

[11] Patent Number: 5,914,010

[45] Date of Patent: Jun. 22, 1999

[54] APPARATUS FOR SOLVENT-DEASPHALTING RESIDUAL OIL CONTAINING ASPHALTENES

[75] Inventors: Richard L. Hood, Edmond, Okla.; Philip B. Rettger, Walnut Creek, Calif.

[73] Assignee: Ormat Industries Ltd., Yavne, Israel

[21] Appl. No.: 08/710,545

[22] Filed: Sep. 19, 1996

[51] Int. Cl.[6] ..... B01D 11/02

[52] U.S. Cl. ..... 196/14.52; 208/309; 208/311; 208/337

[58] Field of Search ..... 196/14.52; 208/309, 208/311, 337

[56] References Cited

U.S. PATENT DOCUMENTS

| | | | |
|---|---|---|---|
| 2,010,008 | 8/1935 | Bray | 208/308 |
| 2,669,538 | 2/1954 | Yurasko et al. | 208/309 |
| 2,850,431 | 9/1958 | Smith | 196/14.46 |
| 2,943,050 | 6/1960 | Beavon . | |
| 3,423,308 | 1/1969 | Murphy . | |
| 4,017,383 | 4/1977 | Beavon . | |
| 4,279,739 | 7/1981 | Roach | 208/309 |
| 4,395,330 | 7/1983 | Auboir et al. . | |
| 4,784,753 | 11/1988 | Hotier et al. | 208/309 |

*Primary Examiner*—Walter D. Griffin
*Assistant Examiner*—Nadine Preisch
*Attorney, Agent, or Firm*—Nath & Associates; Gary M. Nath; Donald M. Sandler

[57] ABSTRACT

A feed stream of asphaltene-containing residual oil is processed by contacting the feed stream with a solvent to form a first primary liquid stream containing deasphalted oil (DAO) and some solvent, and a second primary liquid stream containing asphaltene and some solvent. The first and second liquid streams are heated; and the heated streams are respectively processed to recover the solvent and to produce a DAO product stream substantially free of solvent, and an asphaltene product stream substantially free of solvent. A portion of the DAO product stream is heated to produce a stream of heated DAO, a portion of which indirectly heats the two primary liquid streams.

13 Claims, 2 Drawing Sheets

APPARATUS FOR SOLVENT-DEASPHALTING RESIDUAL OIL CONTAINING ASPHALTENES

TECHNICAL FIELD

This invention relates to a process and apparatus for solvent-deasphalting residual oil containing asphaltenes.

BACKGROUND OF THE INVENTION

Asphaltene-containing residual oil is a residue by-product of refineries that process crude oil into economically valuable light hydrocarbons, such as gasoline, and of coal hydrogenation plants that convert coal into liquid fuels. Residual oil is a heavy, viscous hydrocarbon unsuitable for conventional refinery processing by hydrodesulfurization, hydrocracking, or catalytic cracking because of the excessive amounts of included asphalt and metals. Conventionally, residual oil is further processed in a solvent-deasphalting plant by contacting a feed stream of residual oil with a solvent such as iso-butane, normal-butane, n-pentane, isohexane, etc. under such conditions of temperature and pressure that the mixture separates into two primary liquid streams: a primary stream of deasphalted oil (DAO) and most of the solvent, and a primary stream of asphaltene and the remainder of the solvent. The solvent in these streams is recovered in a solvent recovery unit for re-use. Although the asphaltene product is of relatively limited value, the DAO product is very valuable because it can be recycled back to a refinery where it is converted into gasoline or the like.

Conventionally, solvent recovery units separately add heat to, and then process, each primary stream in two steps. First, the streams are applied to respective vaporization towers wherein most of the solvent in the heated streams is flashed to a vapor producing respective streams with reduced solvent. Then, the reduced solvent streams are applied to respective strippers, wherein, an inert gas, such as steam, strips the remaining solvent from the reduced solvent streams to produce separate product streams of DAO and asphaltene substantially free of solvent.

Early approaches to adding heat to the primary stream of asphaltene and solvent are described in U.S. Pat. Nos. 2,943,050, 3,423,308, and 4,017,383. These patents disclose applying this primary stream to a furnace heated by a flame. This approach proved to be unsatisfactory because, in order to raise the temperature of the stream to a value at which solvent recovery in a vaporization tower can be effected, the temperature of the furnace walls at many locations approached asphalt decomposition temperature. As an alternative arrangement, the primary stream of asphaltene and solvent was indirectly heated with hot oil flowing in a closed loop. However, this arrangement added significantly to the cost of a deasphalting unit because decomposition or contamination of the hot oil occurred over a period of time.

These problems are overcome using the expedient disclosed in U.S. Pat. No. 4,395,330 wherein a portion of the stream of reduced solvent DAO produced by a vaporization tower prior to the stripping process is indirectly heated and used to indirectly heat the primary stream of asphaltene and solvent before being admixed with the primary stream of DAO and solvent. A drawback to this expedient is the increased physical size of the DAO recovery circuit, and difficulty in controlling the temperature of the vaporization tower. Absent adequate temperature controls, the vaporization tower is subject to sporadic carry-over of DAO into the solvent. Furthermore, the DAO added to the primary stream of DAO and solvent reduces the efficiency of the vaporization tower in separating solvent from the DAO.

It is therefore an object of the present invention to provide a new and improved process and apparatus for solvent-deasphalting asphaltene-containing residual oil which overcomes the drawbacks of the prior art discussed above.

BRIEF DESCRIPTION OF THE INVENTION

The present invention, provides for solvent-deasphalting a feed stream of asphaltene-containing residual oil by contacting the feed stream with a solvent to form a first liquid stream containing deasphalted oil (DAO) and some solvent, and a second liquid stream containing asphaltene and some solvent. The first and second liquid streams are heated; and the heated streams are respectively processed to recover the solvent and to produce a DAO product stream substantially free of solvent, and an asphaltene product stream substantially free of solvent. A portion of the DAO product stream is heated to produce a stream of heated DAO, a portion of which indirectly heats the second liquid stream containing asphaltene and solvent. The second liquid stream thus is heated by a thermal fluid, which operates in an open-loop, and whose temperature can be carefully controlled. Moreover, because the thermal fluid is actually one of the product streams that is continually replaced, the thermal fluid is not subject to contamination or breakdown over time.

Preferably, another portion of the heated DAO product is used to indirectly heat the first liquid stream of DAO and solvent. Preferably, a still further portion of the heated DAO product is used to heat a portion of the asphaltene product stream to form a heated portion; and both the heated portion and the heated second liquid stream are processed to produce an asphaltene product stream substantially free of solvent.

BRIEF DESCRIPTION OF THE DRAWINGS

An embodiment of the invention is shown by way of example in the accompanying drawings wherein.

DETAILED DESCRIPTION

Figure 1:
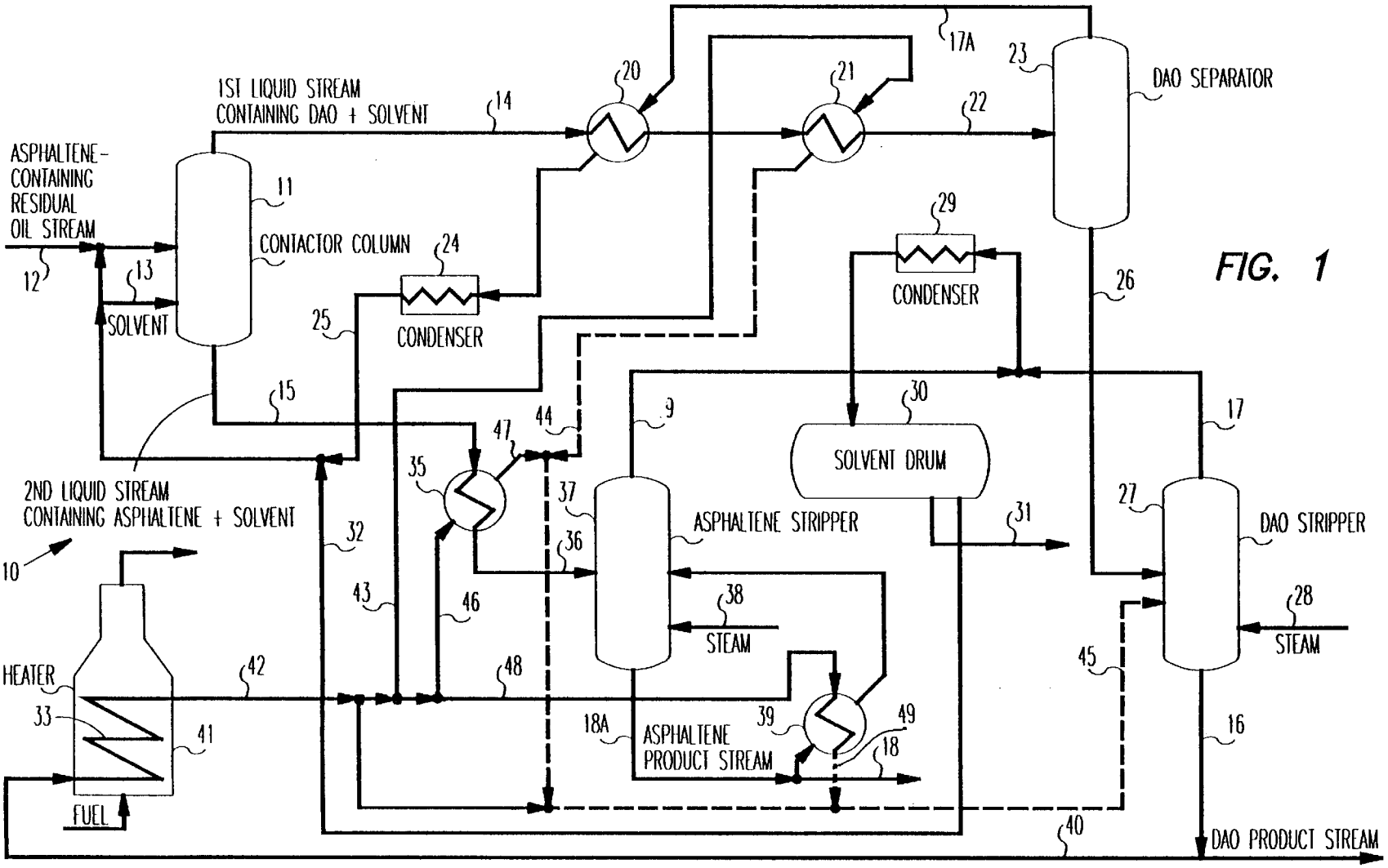
FIG. 1 is a block diagram showing, in a schematic manner, apparatus according to the present invention for solvent-deasphalting residual oil that contains asphaltenes.

Turning now to the drawings, reference numeral 10 designates apparatus according to the present invention for solvent-deasphalting asphaltene-containing residual oil. Apparatus 10 includes a contact member in the form of contactor column 11 to which is applied a feed stream of asphaltene-containing residual oil in conduit 12 and a light hydrocarbon solvent in conduit 13. The solvent and residual oil may be separately, or blended and applied to the column.

The operating conditions of contactor column 11 are well known, and are mentioned only briefly for reference purposes. The ratio by volume of solvent to to the residual oil is about 2 to 15, and preferably from 8 to 13. The temperature at which the column operates is a function of the solvent, and is normally between 70° C. and 220° C. For example, when pentane is the solvent, the normal temperature would be between 169° C. and 196° C., and usually about 180° C., top and bottom. Generally, a reheater (not shown) is built into the top of column 11. Based on the temperature in column 11, separation of the mixture of residual oil and solvent occurs forming an interface. As a result, a mixture of deasphalted oil (DAO) and most of the solvent is discharged at the top of the column into conduit 14 as a first liquid stream, and a mixture of asphaltene and the remainder of the solvent is discharged at the bottom of the column into conduit 15 as a second liquid stream.

The first liquid stream is heated and processed to produce, in conduit 16, a DAO product stream substantially free of solvent, and in conduits 17 and 17A, solvent streams. The second liquid stream in conduit 15 is heated and processed to produce, in conduit 18, an asphaltene product stream substantially free of solvent, and in conduit 19, a solvent stream.

The first liquid stream in conduit 14 is heated in heat exchangers 20 and 21 to form a heated stream that flows through conduit 22 to DAO separator 23 which represents an evaporator column in which solvent flashes into a vapor, or a supercritical solvent recovery column in which the supercritical phase of the solvent separates. From the top of separator 23, vaporized solvent or supercritical solvent flows into conduit 17A and onto heat exchanger 20 where preheating of the liquid stream in conduit 14 takes place. The resultant cooled vapor, or sub-critical fluid, leaving heat exchanger 20 is condensed in condenser 24 before the condensed solvent in conduit 25 is returned to contactor column 11.

From the bottom of of separator 23, a stream of DAO and reduced solvent flows in conduit 26 to DAO stripper 27 to which an inert gas, preferably steam, is applied via conduit 28. The steam strips the remaining solvent from the DAO producing a mixture of steam and solvent that flows out the top of the stripper into conduit 17, and DAO product that flows out the bottom of the stripper into conduit 16. Finally, the mixture of steam and solvent in conduit 17 is condensed in condenser 29 and returned to solvent drum 30. Sour water (i.e., steam condensate) in this drum is removed at 31, and the recovered solvent is available via conduit 32 for use in contactor column 11.

The second liquid stream in conduit 15 is heated in heat exchanger 35 to form a heated stream that flows through conduit 36 to asphaltene stripper 37 to which an inert gas, preferably steam, is applied via conduit 38. The steam strips solvent from the second liquid stream producing a mixture of steam and solvent that flows out of the top of the stripper into conduit 19, and asphaltene product that flows out of the bottom of the stripper into conduit 18. To produce an asphaltene product stream in conduit 18 that is substantially free of solvent, a portion of the asphaltene product stream flowing from the bottom of stripper 37 may be heated in heat exchanger 39 to form a heated portion which is fed back to the stripper.

The invention is concerned with supplying heat to heat exchangers 21, 35, and 39. According to the invention, these heat exchangers are supplied with a portion of the DAO product stream flowing in conduit 16, such portion being heated to produce a stream of heated DAO which is supplied to the heat exchangers from which the cooled DAO is returned to DAO stripper 27. The stream of heated DAO acts as a thermal fluid for heating the first liquid stream in conduit 14, the second liquid stream flowing in conduit 15, and the asphaltene product stream produced by asphaltene stripper 37. However, the material of the thermal fluid constantly changes with the result that thermal decomposition of the thermal fluid is avoided. Moreover, the temperature of the thermal fluid can be closely controlled to enhance to operation of the DAO separator.

As shown in FIG. 1, conduit 40 carries a portion of DAO product produced by stripper 27 to coils 33 in heater 41 which is supplied with fuel for heating such portion to a predetermined temperature consistent with the operation of the deasphalting unit. The heated portion of DAO flows in conduit 42 to heat exchangers 21, 35, and 39. Specifically, some of the heated portion of DAO flows in conduit 43 to heat exchanger 21 wherein the first liquid stream flowing in conduit 14 is indirectly heated by the DAO producing cooled DAO that is directed via conduit 44 to header 45 which returns the cooled DAO to stripper 27. The broken lines in the FIG. 1 designated by reference numeral 44, for example, are used to clarify the return path for DAO product that is cooled after exchanging heat.

Some of the heated portion of DAO flows in conduit 46 to heat exchanger 35 wherein the second liquid stream flowing in conduit 15 is indirectly heated by the DAO producing cooled DAO that is directed via conduit 47 to header 45 which returns the cooled DAO to stripper 27.

Finally, the remainder of the heated portion of DAO flows in conduit 48 to heat exchanger 39 wherein a portion of asphaltene product produced by stripper 37 flowing in conduit 18A is indirectly heated by the DAO producing cooled DAO that is directed via conduit 49 to header 45 which returns the cooled DAO to stripper 27.

Heater 41 may be supplied with conventional fuel which burns to produce the heat required for heating the portion of DAO product flowing in conduit 40. Products of combustion are released from the stack of heater 41.

Alternatively, the fuel for the heater may be supplied by the product streams or their combinations. This modification is shown in FIG. 2 wherein heater 41A is supplied with a portion of the residual oil feed stream flowing in conduit 12, or asphaltene from the asphaltene product stream flowing in conduit 18, or DAO from the DAO product stream flowing in conduit 16, or a combination of asphaltene and DAO.

Figure 2:
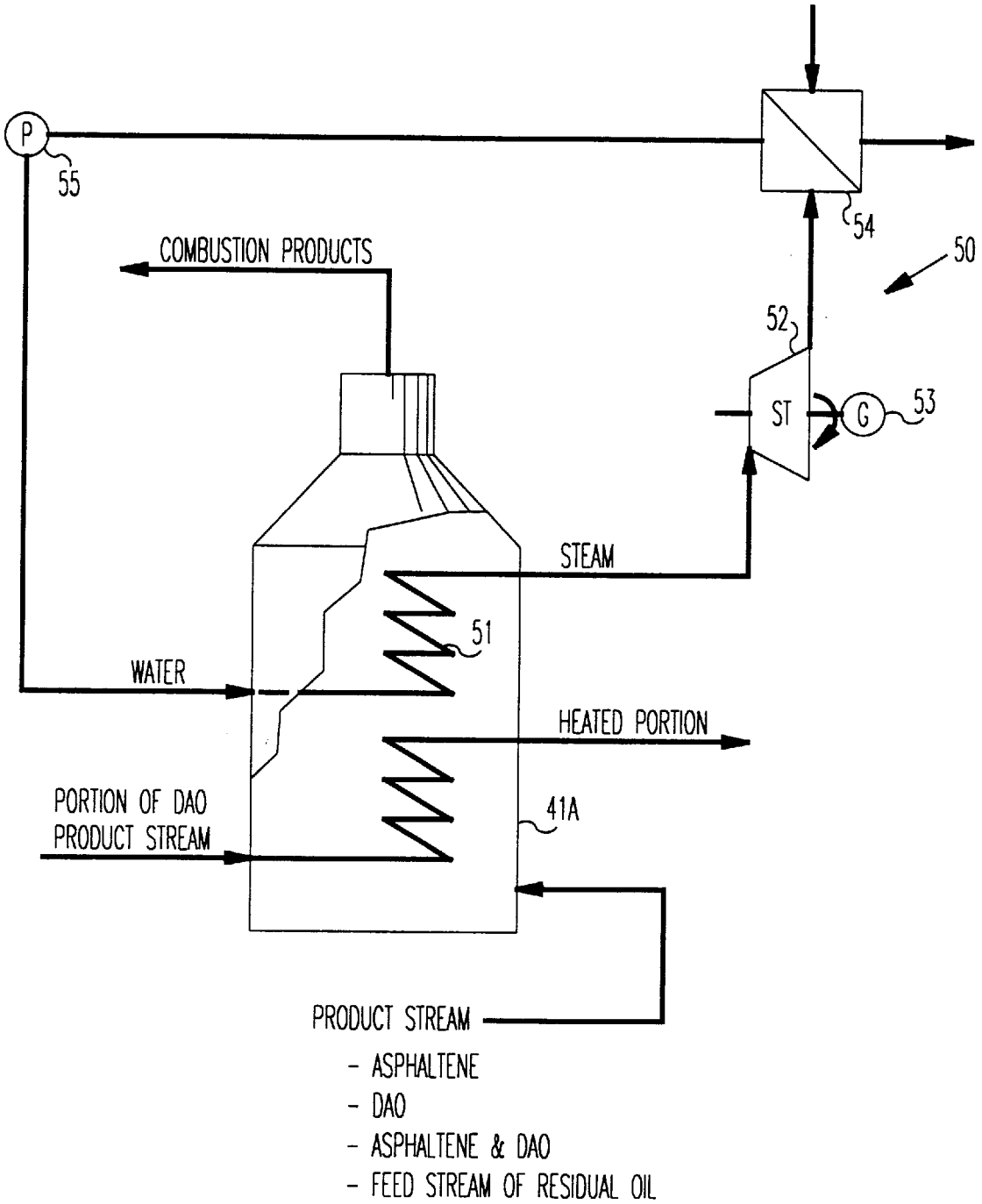
FIG. 2 is a block diagram of a heater used in the present invention but designed to produce power as well as to heat a portion of the DAO product stream.

In addition to supplying the necessary heat for the deasphalting operation, heater 41A may also provide heat that can be converted to electrical power as shown in FIG. 2. Specifically, waste heat power plant 50 may be associated with heater 41A. Plant 50 includes vaporizer coils 51 containing a working fluid, for example, water, or an organic fluid such as pentane, which is vaporized to produce vaporized working fluid, and turbine 52 coupled to generator 53, and responsive to the vaporized working fluid for driving the generator and producing power and expanded working fluid. Also included in plant 50 is condenser 54 that indirectly condenses the expanded working fluid to a liquid which is returned to coils 51 by pump 55.

The working fluid thus operates in a closed loop which simplifies maintenance. The preferred working fluid is water, and in such case, coils 51 represent evaporator and superheater coils. In an alternative arrangement, the working fluid could be an organic fluid, and plant 50 can be a combined cycle plant that uses a steam turbine whose exhaust is condensed using an organic fluid supplied to an organic vapor turbine.

Heater 41A can be constructed as a direct boiler, a circulating fluid bed combustor, or as a gasifier depending upon the sulfur level in the product being burned. The heater can also supply only power, or heat a thermal fluid only, or generate power and heat a thermal fluid as shown in FIG. 2.

The advantages and improved results furnished by the method and apparatus of the present invention are apparent from the foregoing description of the preferred embodiment of the invention. Various changes and modifications may be made without departing from the spirit and scope of the invention as described in the appended claims.

We claim:

1. Apparatus for solvent-deasphalting a feed stream of asphaltene-containing residual oil comprising:

a) a contact member for contacting said feed stream with a solvent to form a first liquid stream containing deasphalted oil (DAO) and some solvent, and a second liquid stream containing asphaltene and some solvent;

b) a first heat exchanger for heating said first liquid stream to form a heated first stream;

c) first processing apparatus for processing said heated first stream to produce a DAO product stream substantially free of solvent, and a first vaporized solvent stream, said first processing means including:

(1) a first flash drum that receives said heated first stream and produces said first solvent stream, and a stream of DAO and reduced solvent; and (2) a first stripper for stripping solvent from said stream of DAO and reduced solvent using an inert gas to form said DAO product stream substantially free of solvent, and a second vaporized solvent stream containing said inert gas;

d) a heater for heating a portion of said DAO product stream to produce a stream of heated DAO at a temperature in excess of the temperature of said flash drum;

e) means for directing a portion of said stream of heated DAO to said first heat exchanger for indirectly heating said first liquid stream and producing a heat depleted DAO stream; and f) means for directing at least some of said heat depleted DAO stream to said first stripper.

2. Apparatus according to claim 1 including:

a) a second heat exchanger for heating said second liquid stream to form a heated second liquid stream;

b) second processing apparatus for processing said heated second liquid stream to produce an asphaltene product stream substantially free of solvent, and a third vaporized solvent stream;

c) means for directing a portion of said heated DAO to said second heat exchanger for indirectly heating said second liquid stream and producing an additional heat depleted DAO stream; and d) means for directing at least some of said additional heat depleted DAO stream to said first stripper.

3. Apparatus according to claim 2 including a further heat exchanger upstream of said first heat exchanger, and responsive to said first vaporized solvent stream for pre-heating said first liquid stream before the latter is heated in said first heat exchanger and producing a heat depleted vaporized solvent stream.

4. Apparatus according to claim 2 wherein said second processing apparatus includes an asphaltene stripper for stripping solvent from said heated second liquid stream using an inert gas to form said asphaltene product stream and said second solvent stream which contains said inert gas.

5. Apparatus according to claim 4 including a heat exchanger responsive to said heated DAO for heating a portion of said asphaltene product stream to form a heated portion; and means for returning said heated portion to said asphaltene stripper.

6. Apparatus according to claim 4 including a condenser for condensing said second solvent stream and said third solvent stream to produce a liquid solvent stream containing condensed inert gas, and a solvent drum for collecting condensate produced by said condenser.

7. Apparatus according to claim 3 including a condenser for condensing said heat depleted vaporized solvent stream to produce a liquid solvent stream, and means for for returning said liquid solvent stream to said contact member.

8. Apparatus according to claim 1 wherein said heater is an indirect contact heat exchanger that is responsive to heated heat transfer fluid that indirectly contacts said portion of DAO product stream.

9. Apparatus according to claim 1 including a combustor for burning fuel, and a heat exchanger associated with said combustor for heating said portion of said DAO product stream.

10. Apparatus according to claim 9 including a further heat exchanger associated with said combustor containing a working fluid that is vaporized to produced vaporized working fluid, a turbine responsive to said vaporized working fluid for expanding the same and producing power and expanded working fluid, a condenser for condensing said expanded working fluid to a liquid, and means for returning said liquid to said further heat exchanger.

11. Apparatus according to claim 1 including a further heat exchanger upstream of said first heat exchanger, and responsive to said first vaporized solvent stream for pre-heating said first liquid stream before the latter is heated in said first heat exchanger and a producing heat depleted vaporized solvent stream.

12. Apparatus according to claim 3 including a condenser for condensing said heat depleted vaporized solvent stream to a liquid solvent stream, and means for returning said liquid solvent stream to said contact member.

13. Apparatus according to claim 3 including means for feeding back heated DAO to said first stripper.

* * * * *